United States Patent [19]

Spindler

[11] Patent Number: 4,631,646

[45] Date of Patent: Dec. 23, 1986

[54] DISCARDABLE FLASHLIGHT

[75] Inventor: Hans Spindler, Remchingen-Singen, Fed. Rep. of Germany

[73] Assignee: Trautz & Co. Inh. Hans Spindler, Pforzheim, Fed. Rep. of Germany

[21] Appl. No.: 831,134

[22] Filed: Feb. 18, 1986

[30] Foreign Application Priority Data

Feb. 22, 1985 [DE] Fed. Rep. of Germany ... 8505037[U]

[51] Int. Cl.[4] ..... F21L 7/00

[52] U.S. Cl. ..... 362/118; 362/189; 362/196; 362/201

[58] Field of Search ..... 362/118, 189, 196, 204, 362/205, 206, 208, 202, 203

[56] References Cited

U.S. PATENT DOCUMENTS

| | | | |
|---|---|---|---|
| 3,711,703 | 1/1973 | Bacevius | 362/189 |
| 4,433,365 | 2/1984 | Rousseau | 362/189 |
| 4,495,551 | 1/1985 | Foltz | 362/208 |
| 4,559,588 | 12/1985 | Engelson et al. | 362/189 |

*Primary Examiner*—William A. Cuchlinski, Jr.
*Assistant Examiner*—D. M. Cox
*Attorney, Agent, or Firm*—Balogh, Osann, Kramer, Dvorak, Genova & Traub

[57] ABSTRACT

A discardable flashlight comprises a housing provided at one end with a lampholder assembly and containing a forward battery, which is disposed adjacent to and electrically connected to said lampholder assembly, and a rear battery, which is remote from said lampholder assembly and adapted to be electrically connected in series with said forward battery and said lampholder assembly. Spring means are provided for laterally urging the forward portion of the rear battery to a break position in which it is electrically disconnected from the forward battery. A fingerpiece is provided, which laterally engages the rear battery at said forward portion opposite to said spring means and is manually depressible to push the rear battery to a position in which it is electrically connected to said forward battery.

11 Claims, 6 Drawing Figures

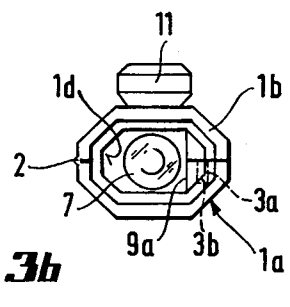
Fig. 3b
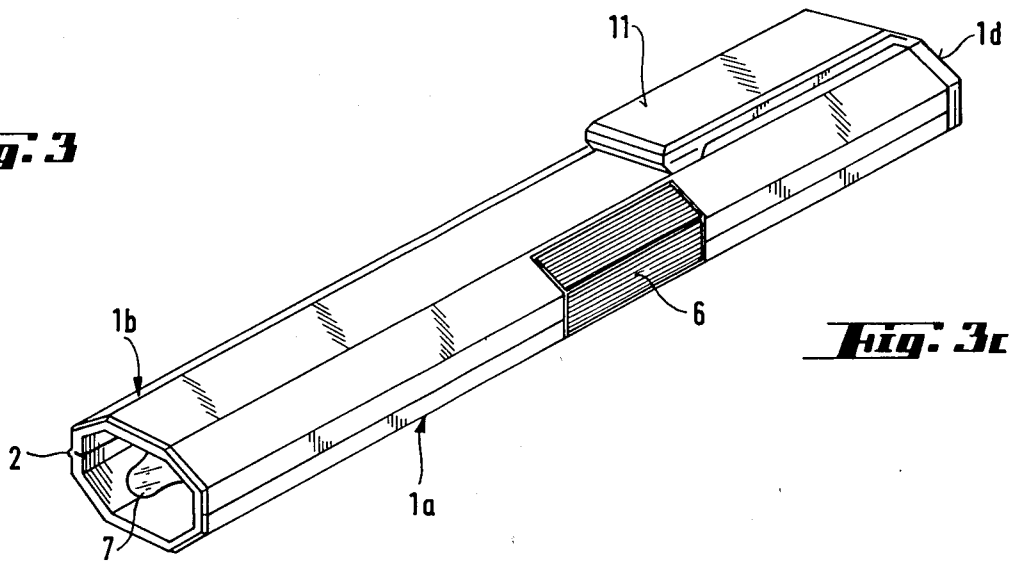
Fig. 3c
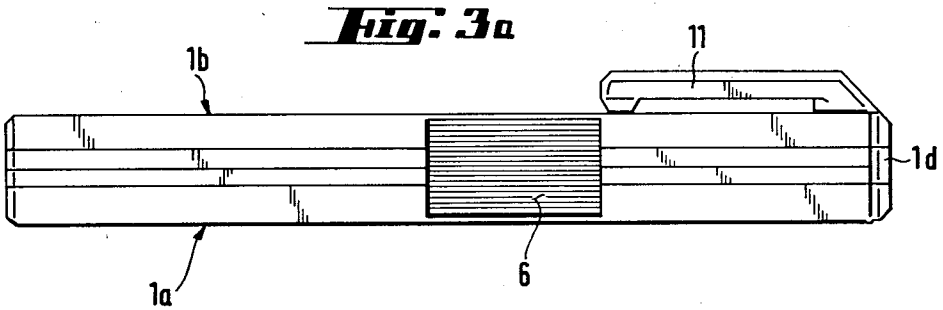
Fig. 3a
Fig. 3

DISCARDABLE FLASHLIGHT

BACKGROUND OF THE INVENTION

1. Field of the Invention

This invention relates to a discardable flashlight comprising a housing and a plurality of batteries which are stacked in said housing.

2. Description of the Prior Art

Midget and pocket flashlights are known which comprise a housing or sheath containing a battery or a plurality of series-connected batteries, which are connected in circuit with a lampholder assembly by means of contact springs, one of which is adapted to be depressed by means of a manually slidable fingerpiece so that said one contact spring contacts a contact spring associated with a lampholder in order to energize a lamp held therein. Said known flashlights can be arbitrarily switched on and off.

SUMMARY OF THE INVENTION

It is an object of the invention to provide a discardable flashlight which can be inserted into a pocket like a pen and may be provided with a clip and which is arranged to be energized only as long as a fingerpiece is depressed whereas the flashlight is extinguished as the fingerpiece is released.

In a discardable flashlight comprising a housing and a plurality of batteries contained in said housing and connected in series with each other and with a lampholder assembly, that object is accomplished in accordance with the invention in that a forward battery and a rear battery are connected in series and respectively disposed adjacent to and remote from the lampholder assembly, rear battery is spring-biased in a lateral direction and is thus laterally displaced and electrically disconnected from the forward battery, and a fingerpiece is provided, which engages the rear battery on one side thereof and is operable to laterally push said rear battery against the spring bias to a position in which it electrically contacts the forward battery to complete the circuit including the batteries and the lampholder assembly.

The two series-connected midget batteries may be surrounded by a plastic housing, which consists of two parts, which are connected by a hinge.

BRIEF DESCRIPTION OF THE DRAWING

FIGS. 3, 3*a*, 3*b*, and 3*c* show a perspective view, a side elevation and an end view showing the housing in a closed position.

DETAILED DESCRIPTION OF THE PREFERRED EMBODIMENT

Figure 1:
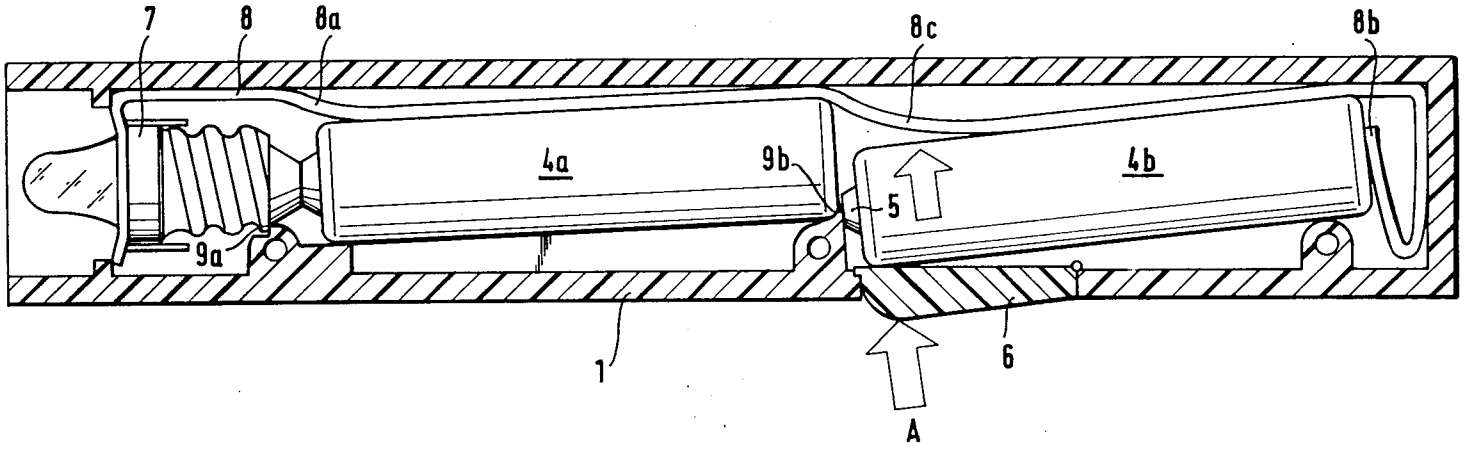
FIG. 1 is a diagrammatic sectional view showing a discardable flashlight in accordance with the invention.

Further details of the invention will become apparent from the following description of a preferred illustrative embodiment of the invention which is shown in the drawing.

It is apparent from the drawing that the discardable flashlight comprises a plastic housing 1, which consists of two shell members 1*a* and 1*b*, which are interconnected by a longitudinally extending film hinge 2 so that the housing can be swung open. The shell members 1*a* and 1*b* can be locked in their closed position by a pinhole joints 3*a*, 3*b*.

The plastic housing 1 contains two midget batteries 4*a* and 4*b*, which are adapted to be electrically connected in series. The flashlight also comprises a lampholder assembly 7, which consists of a lampholder and a lamp in said lampholder and is disposed adjacent to the battery 4*a*, which is described as a forward battery whereas the battery 4*b* is described as a rear battery. As is apparent from the diagrammatic FIG. 1 the rear battery 4*b* is laterally biased by spring means urging the forward end portion 5 of the rear battery 4*b* in a lateral direction to a break position, in which the rear battery 4*b* is out of contact with the forward battery 4*a*. The housing 1 is integrally formed with a lanced lug-shaped fingerpiece 6, which can be depressed by a finger so that the forward portion 5 of the rear battery will be moved in the direction A to a make position, in which an electric contact is established between the adjacent poles of batteries 4*a* and 4*b*.

An electrically conducting metal spring 8 extends from and is in electric contact with the lampholder assembly 7 and extends along the midget batteries 4*a* and 4*b*. That spring 8 has a bulge 8*a*, which bears on the forward battery 4*a* and urges the latter against an abutment 9*a*, which is integrally formed with the housing 1. At its end that is remote from the lampholder assembly 7, the spring 8 has a laterally extending lug 8*b*, which bears on the rear end of the rear battery 4*b* so that the spring 8 urges the two batteries toward the lampholder assembly 7 and thus constitutes also a contact spring.

Behind the bulge 8*a*, the spring 8 is formed with a larger bulge 8*c*, which bears on the forward portion 5 of the rear battery 4*b* and laterally urges said forward portion against the abutment 9*b* to a position in which the rear battery 4*b* is electrically disconnected from the forward battery 4*a*. On the side which is opposite to the bulge 8*c* of the spring 8, the plastic housing 1 is integrally formed with the finger piece 6, which is manually depressible to complete the circuit. That fingerpiece 6 is held in a position of rest by interlocking detent portions 6*a* and 6*b* shown in FIG. 2.

Figure 2:
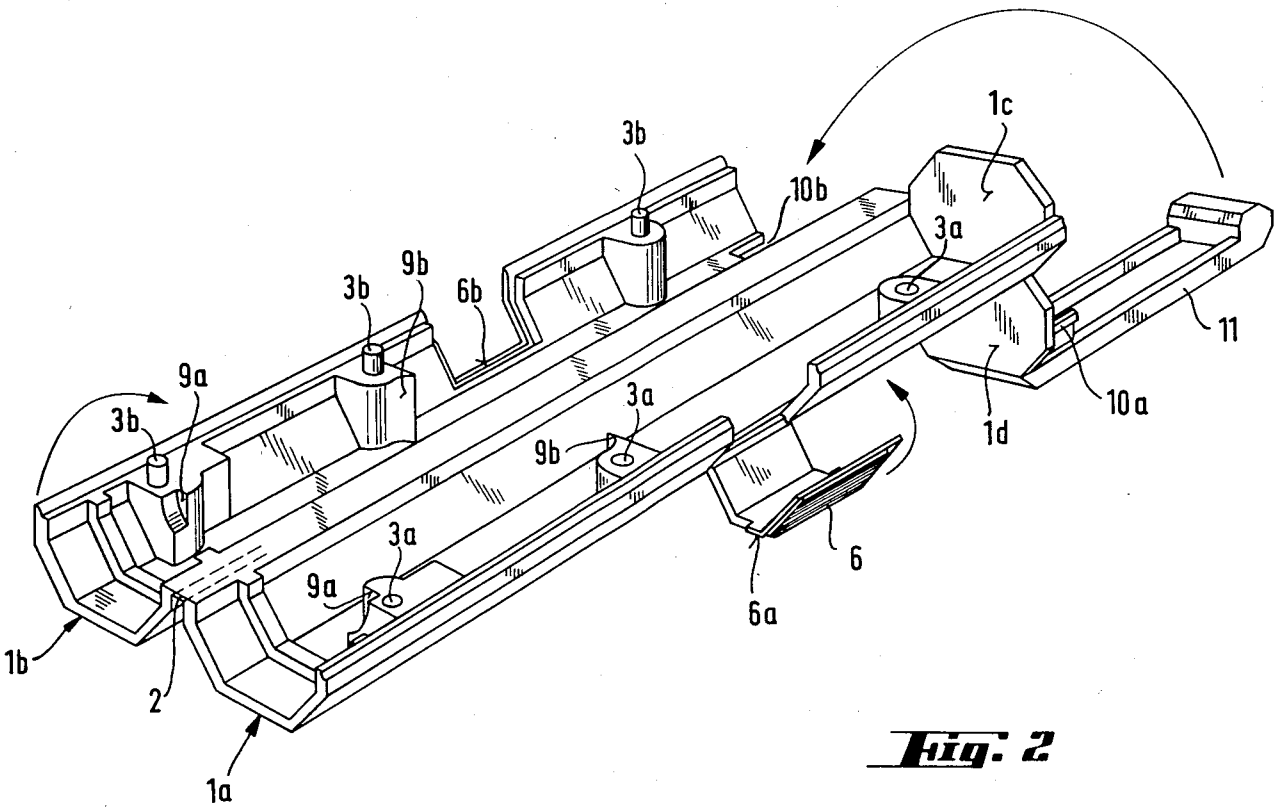
FIG. 2 is a perspective view showing the housing in an open position.

It is apparent from FIGS. 2 and 3 that the shell member 1*a* of the housing is formed at its rear end with a bottom 1*c* and with a retaining lug 10*a*, which comprises a second bottom 1*d*, which is hinged to the shell member 1*a* at the bottom 1*c*, and clip portion 11. When the shell member 1*b* has been swung to a closed position the lug 10*a* can be swung to a position in which the second bottom 1*d* overlies the bottom 1*c*, the clip portion 11 overlies and bears on the shell member 1*b* and the parts are held together in that a detent element 10*a* of the lug 10*a* fits into a notch 10*b* at the rear end of the shell member 1*b*. That condition of the flashlight is shown in FIG. 3. In that condition the clip portion 11 can be used to retain the flashlight like a pen in a pocket.

I claim:

1. In a discardable flashlight comprising a housing having forward and rear ends, a lampholder assembly mounted in said housing at said forward end, two batteries, which are stacked in said housing, and manually operable control means for connecting said batteries in circuit with said lampholder assembly, the improvement residing in that each of said batteries has a forward portion and a rear portion, said forward portion of said forward battery is in electric contact with said lampholder assembly, said forward portion of said rear battery is laterally movable in said housing between a make position, in which said forward portion of said rear battery is in electric contact with said rear portion of said forward battery, and a break position, in which said electric contact is eliminated, conducting means are provided, which are arranged to connect said batteries in series with each other and with said lampholder assembly when said forward portion of said rear battery is in said make position, spring means are contained in said housing and bear on one side of said forward portion of said rear battery and urge said forward portion of said rear battery toward said break position, and said control means comprises a fingerpiece, which is carried by said housing and accessible from the outside and bears on said forward portion of said rear battery, on the side which is opposite to said spring means, and said fingerpiece is manually depressible to move said forward portion of said rear battery from said break position to said make position against the force of said spring means.

2. The improvement set forth in claim 1, wherein said batteries consist of midget batteries.

3. The improvement set forth in claim 1, wherein said housing consists of plastic material.

4. The improvement set forth in claim 1, wherein said housing comprises two housing members and a longitudinal hinge connecting them.

5. The improvement set forth in claim 1, wherein said housing comprises an internal abutment adjacent to said forward battery and said conducting means and said spring means comprise a metal spring, which is electrically connected to said lampholder assembly and extends along said batteries on said one side and urges said forward battery against said abutment, and said spring has a spring lug bearing on the rear end of said rear battery and in mechanical and electric contact therewith and urging said batteries toward said lampholder assembly.

6. The improvement set forth in claim 5, wherein said housing comprises adjacent to said forward end portion of said rear battery on the other side thereof a second abutment, which is arranged to be engaged by said forward portion of said rear battery in said break position, and said spring has an inwardly directed bulge bearing on said forward end portion of said rear battery on said one side thereof and urging said forward end portion of said rear battery toward said break position.

7. The improvement set forth in claim 6, wherein said fingerpiece consists of a lug, which is integrally formed in said housing, and said lug and said fingerpiece are formed with detent elements, which are interengageable to resist a movement of said fingerpiece away from said housing under the action of said spring.

8. The improvement set forth in claim 1, wherein said housing comprises two housing members, which are connected by a film hinge extending along said housing on one side thereof.

9. The improvement set forth in claim 8, wherein said housing members are provided with interfitting pin-and-socket means on the side which is opposite to said hinge.

10. The improvement set forth in claim 8, wherein one of said housing members comprises at said rear end a retaining lug, which is adapted to interlock with the other of said housing members.

11. The improvement set forth in claim 10, wherein said retaining lug comprises a clip, which extends on the outside of said housing and is adapted to retain said flashlight in a pocket of a wearer.

* * * * *